US009966684B2

(12) United States Patent
Ko et al.

(10) Patent No.: US 9,966,684 B2
(45) Date of Patent: May 8, 2018

(54) CONNECTOR ASSEMBLY

(71) Applicant: Samsung Electronics Co., Ltd., Suwon-si (KR)

(72) Inventors: Byunghoon Ko, Hwaseong-si (KR); Hyungwoo Lee, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days. days.

(21) Appl. No.: 15/163,952

(22) Filed: May 25, 2016

(65) Prior Publication Data

US 2017/0170590 A1 Jun. 15, 2017

(30) Foreign Application Priority Data

Dec. 15, 2015 (KR) ..... 10-2015-0179457

(51) Int. Cl.

| | |
|---|---|
| ***H01R 13/24*** | (2006.01) |
| ***H01R 13/52*** | (2006.01) |
| ***H01R 13/627*** | (2006.01) |
| ***H01R 12/78*** | (2011.01) |
| ***H01R 13/62*** | (2006.01) |

(52) U.S. Cl.

CPC ..... *H01R 13/2407* (2013.01); *H01R 12/78* (2013.01); *H01R 13/5219* (2013.01); *H01R 13/62* (2013.01); *H01R 13/6278* (2013.01); *H01R 13/6271* (2013.01)

(58) Field of Classification Search

CPC ..... H01R 13/24; H01R 13/2407
USPC ..... 439/289
See application file for complete search history.

(56) References Cited

U.S. PATENT DOCUMENTS 2,486,195 A * 10/1949 Munsey ..... H01R 13/22 439/278
3,478,298 A * 11/1969 Nelson ..... H01R 13/523 439/205
3,657,681 A * 4/1972 Falkner ..... H01R 13/523 439/205
3,742,427 A * 6/1973 Ballard ..... H01R 13/523 439/188
3,784,959 A * 1/1974 Horton ..... H01R 13/523 439/275
3,994,552 A * 11/1976 Selvin ..... H01R 13/523 439/278

(Continued)

FOREIGN PATENT DOCUMENTS

DE 10 2014 007 849 A1 11/2015
EP 2 940 804 A1 11/2015

(Continued)

OTHER PUBLICATIONS

Extended European Search Report dated Apr. 24, 2017 in corresponding European Patent Application No. 16177714.9 (7 pages).

*Primary Examiner* — Neil Abrams
(74) *Attorney, Agent, or Firm* — NSIP Law

(57) ABSTRACT

A connector assembly includes a first connector body, a first elastic layer disposed on the first connector, a first electrode disposed on the first elastic layer, a second connector body, and a second electrode disposed on the second connector, wherein the first elastic layer is configured to provide a compressive force to the first electrode when the first connector body engages the second connector body.

23 Claims, 14 Drawing Sheets

(56) References Cited

U.S. PATENT DOCUMENTS

| | | | | |
|---|---|---|---|---|
| 4,014,600 | A * | 3/1977 | Gisewsky | H01R 13/22 439/289 |
| 4,045,107 | A * | 8/1977 | Sutherland | H01R 13/28 439/289 |
| 4,166,663 | A * | 9/1979 | Walker | G01V 1/201 439/271 |
| 4,516,820 | A * | 5/1985 | Kuzma | A61N 1/3754 439/271 |
| 4,943,243 | A * | 7/1990 | Appleton | H01R 13/22 439/289 |
| 5,451,169 | A * | 9/1995 | Corbett, III | H01R 13/22 439/289 |
| 6,575,764 | B1 * | 6/2003 | Reipur | H01R 13/24 439/289 |
| 6,945,666 | B2 * | 9/2005 | Woolfson | G01P 3/40 315/136 |
| 7,355,122 | B2 * | 4/2008 | Moore | E21B 33/0385 174/84 R |
| 7,695,321 | B2 * | 4/2010 | Cayzac | H01R 13/5219 439/607.41 |
| 9,391,409 | B2 * | 7/2016 | Abe | H01R 13/6582 |
| 2016/0064855 | A1 * | 3/2016 | Wang | H01R 13/6205 439/39 |
| 2017/0170590 | A1 * | 6/2017 | Ko | H01R 13/2407 |

FOREIGN PATENT DOCUMENTS

| | | | |
|---|---|---|---|
| JP | 2004-47188 | A | 2/2004 |
| JP | 2005-116489 | A | 4/2005 |
| JP | 2008-97992 | A | 4/2008 |
| JP | 2010-21052 | A | 1/2010 |
| JP | 2011-54394 | A | 3/2011 |
| JP | 2013-8499 | A | 1/2013 |
| WO | WO 2007/063436 | A1 | 6/2007 |

* cited by examiner

CONNECTOR ASSEMBLY

CROSS-REFERENCE TO RELATED APPLICATION(S)

This application claims the benefit under 35 USC § 119(a) of Korean Patent Application No. 10-2015-0179457, filed on Dec. 15, 2015, in the Korean Intellectual Property Office, the entire disclosure of which is incorporated herein by reference for all purposes.

BACKGROUND

1. Field

The following description relates to a connector assembly.

2. Description of Related Art

There has been a gradual increase in demand for handheld electronic devices and wearable devices. Portable electronic devices, such as the handheld electronic devices and the wearable electronic devices, may include complicated electronic circuits in small areas. Electronic components, such as memory, processors, circuits and batteries, may be vulnerable to water. Water may cause an unintended short-circuit between pins or elements in a circuit. Due to the unintended short-circuit, the circuit may unpredictably operate or be damaged. Also, the circuit may be affected by dust and other pollutants.

In general, the portable electronic devices may include connectors to be paired with an external connector. The connector may include an electrode used for an electrical connection and a housing configured to fix the corresponding connector. The electrode may be provided in a contact point structure that uses a mechanical spring to ensure a stable electrical connection. Such mechanical spring-based connection systems may lack consistent pressure to maintain connection. In addition, if a pressure exceeding a predetermined level is applied to the spring, a restoring force of the spring may be reduced, or the spring may not return to its initial equilibrium position. Thus, the function of the spring may not be performed.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, a connector assembly includes a first connector body, a first elastic layer disposed on the first connector, a first electrode disposed on the first elastic layer, a second connector body, and a second electrode disposed on the second connector, wherein the first elastic layer is configured to provide a compressive force to the first electrode when the first connector body engages the second connector body.

The first electrode may be configured to contact the second electrode upon the first connector body engaging the second connector body.

The first elastic layer may be configured to block a foreign substance entering an area adjacent the first electrode and the second electrode upon the first connector body engaging the second connector body.

The connector assembly may further include a second elastic layer disposed between the second electrode and the second connector body. The second elastic layer may be configured to provide a compressive force to the second electrode upon the first connector body engaging the second connector body.

The connector assembly may further include a shielding member disposed adjacent to at least one of the first electrode and the second electrode. The shielding member may be configured to prevent a foreign substance entering an area adjacent to the first electrode and the second electrode upon the first connector body engaging the second connector body. The shielding member may include an elastic material. The shielding member may be configured to block external electromagnetic waves entering the first electrode and the second electrode upon the first connector body engaging the second connector body. The shielding member may include a conductive material.

The first connector and the second connector may be connected to separate circuits.

At least the first connector may be included in an electronic device that includes a processing device configured to receive a signal from the second connecting body. The second connector body may be a biosensor.

In another general aspect, a connector assembly includes a first connector body, a first elastic layer disposed on the first connector body, a plurality of first electrodes disposed on the first elastic layer, a second connector body, and second electrodes disposed on the second connector body and corresponding to the first electrodes.

The first elastic layer may be configured to provide a compressive force to the first electrodes upon the first connector body connecting to the second connector body.

The first elastic layer may be configured to block a foreign substance entering an area adjacent to the first electrodes and the second electrodes upon the first connector body engaging the second connector body.

The connector assembly may further include a second elastic layer disposed between the second connector body and the second electrodes.

The connector assembly may further include a shielding member disposed in an area adjacent to at least one of the first electrodes and the second electrodes. The shielding member may be configured to block a foreign substance or an electromagnetic wave, or both, from entering an area adjacent to the first electrodes and the second electrodes upon the first connector may be connecting to the second connector.

In another general aspect, a connector assembly includes a first connector, a first elastic layer disposed on the first connector, a first electrode disposed on the first elastic layer, and a processor device electrically connected with the first electrode, wherein the first connector may be configured to be connected to a second connector that supports a second electrode and is configured with a first fastener configured to engage a second fastener of the second connector, the processor device configured to receive a biosignal from a biosensor connected to the second connector.

The connector assembly may further include the second connector, the second electrode disposed on the second connector and corresponding to the first electrode, wherein the second fastener may be configured to receive the first fastener.

The first fastener may be a fastening groove and the second fastener may be a fastening protrusion.

The fastening protrusion may include a laterally outward extending protrusion and the fastening groove may have a corresponding laterally extending groove configured to receive the laterally outward extending protrusion.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1A:
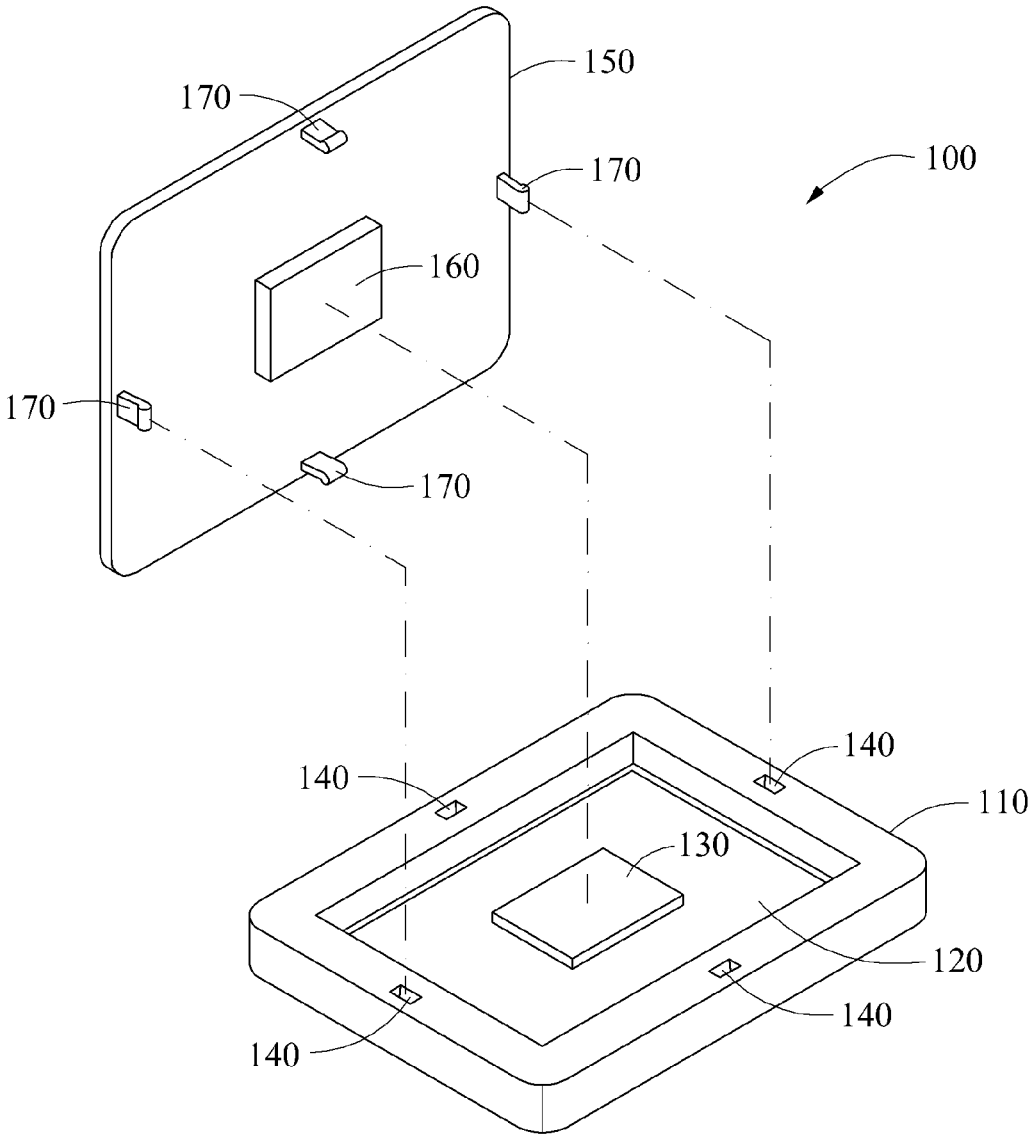
FIGS. 1A and 1B are perspective views illustrating an example of a connector assembly.

The following detailed description is provided to assist the reader in gaining a comprehensive understanding of the methods, apparatuses, and/or systems described herein. However, various changes, modifications, and equivalents of the methods, apparatuses, and/or systems described herein will be apparent to one of ordinary skill in the art. The sequences of operations described herein are merely examples, and are not limited to those set forth herein, but may be changed as will be apparent to one of ordinary skill in the art, with the exception of operations necessarily occurring in a certain order. Also, descriptions of functions and constructions that are well known to one of ordinary skill in the art may be omitted for increased clarity and conciseness.

The features described herein may be embodied in different forms, and are not to be construed as being limited to the examples described herein. Rather, the examples described herein have been provided so that this disclosure will be thorough and complete, and will convey the full scope of the disclosure to one of ordinary skill in the art.

The following specific structural or functional descriptions are examples to merely describe embodiments, and various alterations and modifications may be made to the examples. Here, the examples are not construed as limited to the disclosure and should be understood to include all changes, equivalents, and replacements within the idea and the technical scope of the disclosure.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element without departing from the teachings of the disclosure.

It will be understood that when an element or layer is referred to as being "on", "attached to", or "connected to" another element or layer, it can be directly on or connected to the other element or layer or through intervening elements or layers may be present. In contrast, when an element is referred to as being "directly on", "directly attached to", or "directly connected to" another element or layer, there are no intervening elements or layers present. Other words used to describe the relationship between elements or layers should be interpreted in a like fashion (e.g., "between" versus "directly between," "adjacent" versus "directly adjacent," "on" versus "directly on").

The terminology used herein is for the purpose of describing particular examples only and is not to be limiting of the examples. As used herein, the singular forms "a", "an", and "the" are intended to include the plural forms as well, unless the context clearly indicates otherwise. It will be further understood that the terms "include/comprise" and/or "have" when used in this specification, specify the presence of stated features, integers, operations, elements, components, and/or combinations thereof, but do not preclude the presence or addition of one or more other features, numbers, operations, elements, components, and/or groups thereof.

Unless otherwise defined, all terms including technical and scientific terms used herein have the same meaning as commonly understood by one of ordinary skill in the art to which examples belong after an understanding of the present disclosure. It will be further understood that terms, such as those defined in commonly-used dictionaries, should be interpreted as having a meaning that is consistent with their meaning in the context of the relevant art and the present disclosure and will not be interpreted in an idealized or overly formal sense unless expressly so defined herein.

Words describing relative spatial relationships, such as "below", "beneath", "under", "lower", "bottom", "above", "over", "upper", "top", "left", and "right", may be used to conveniently describe spatial relationships of one device or elements with other devices or elements. Such words are to be interpreted as encompassing a device oriented as illustrated in the drawings, and in other orientations in use or operation. For example, an example in which a device includes a second layer disposed above a first layer based on the orientation of the device illustrated in the drawings also encompasses the device when the device is flipped upside down in use or operation.

The following examples relate to a connector assembly providing an electrical connecting function and are not limited to a specific type of connector assembly. The connector assembly is applicable to, for example, handheld electronic devices, wearable devices, and various types of electronic devices based on an electrical connection.

In the drawings, variations from the shapes of the illustrations as a result, for example, of manufacturing techniques and/or tolerances, may occur. Thus, the example embodiments should not be construed as limited to the particular shapes of regions illustrated herein, but are to include deviations in shapes that result, for example, from manufacturing.

FIG. 1A is a perspective view illustrating an example of a connector assembly 100.

Referring to FIG. 1A, the connector assembly 100 includes a first connector 110 and a second connector 150 configured to be detachably, or removably, attached to each other. The first connector 110 and the second connector 150 are connected to different elements, circuits, or systems. For example, the first connector 110 is electrically connected to one circuit and the second connector 150 is electrically connected to another circuit.

The first connector 110 includes a first electrode 130 configured to send or receive, or both send and receive, an electrical signal and a first fastener 140 configured to connect the first connector 110 and the second connector 150. The first connector 110 also includes a first elastic layer 120 disposed between a body of the first connector 110 and the first electrode 130. The second connector 150 includes a second electrode 160 configured to provide, send, and/or receive an electrical signal and a second fastener 170 configured to connect the second connector 150 and the first connector 110. The first electrode 130 and the second electrode 160 include a conductive material, for example, metal, graphite, conductive rubber, or silicone, or any combination thereof. Also, the first electrode 130 may be directly laminated onto the first elastic layer 120 in a form of layer through, for example, a thin film process. The second electrode 160 may be fixed onto the second connector 150 through, for example, a adhesive or a thin film process. The first fastener 140 and the second fastener 170 are configured to, when interacting or engaging, stably connect the first connector 110 and the second connector 150 such that the first electrode 130 of the first connector 110 contacts the second electrode 160 of the second connector 150.

Figure 1B:
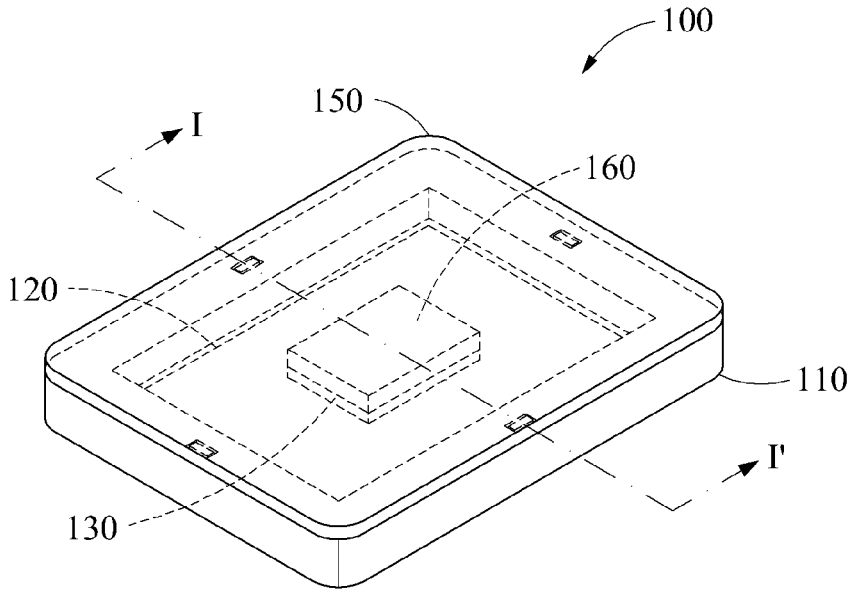

For example, the first fastener 140 and the second fastener 170 are provided in forms of a fastening protrusion and a fastening groove as illustrated in FIGS. 1A and 1B. In this example, the fastening protrusion may include a laterally outward extending protrusion and the fastening groove has a corresponding laterally extending groove configured to receive the laterally outward extending protrusion. The laterally outward extending protrusion and corresponding laterally extending groove may maintain engagement of the first connector 110 with the second connector 150.

In another example, the first fastener 140 and the second fastener 170 may also be provided in a form of a magnetic fastener or a hook and loop fastener. Types of the first fastener 140 and the second fastener 170 are not limited to the aforementioned example and thus, any form of fastening the first connector 110 and the second connector 150 to each other is applicable thereto.

FIG. 1B illustrates the first connector 110 and the second connector 150 connected with each other, e.g., with the first fastener 140 and the second fastener 170 interacting or engaging. Referring to FIG. 1B, in response to a connection between the first connector 110 and the second connector 150, the first electrode 130 contacts the second electrode 160. In this example, the second electrode 160 applies pressure to the first electrode 130, and the first electrode 130 presses into the first elastic layer 120. The first elastic layer 120 is elastically deformed due to the pressure from the second electrode 160 applied to the first electrode 130. The deformed elastic layer 120 applies a compressive force to the first electrode 130 due to a restoring force of the elastic layer 120. The compressive force provided from the first elastic layer 120 and the connection between the first fastener 140 and the second fastener 170 allow the connection, interaction, or engagement between the first electrode 130 and the second electrode 160 to be stably maintained. Here, the elastic layer may be a layer of a non-mechanical material that has elastic characteristics or may be an elastic compound, for example.

Figure 2:
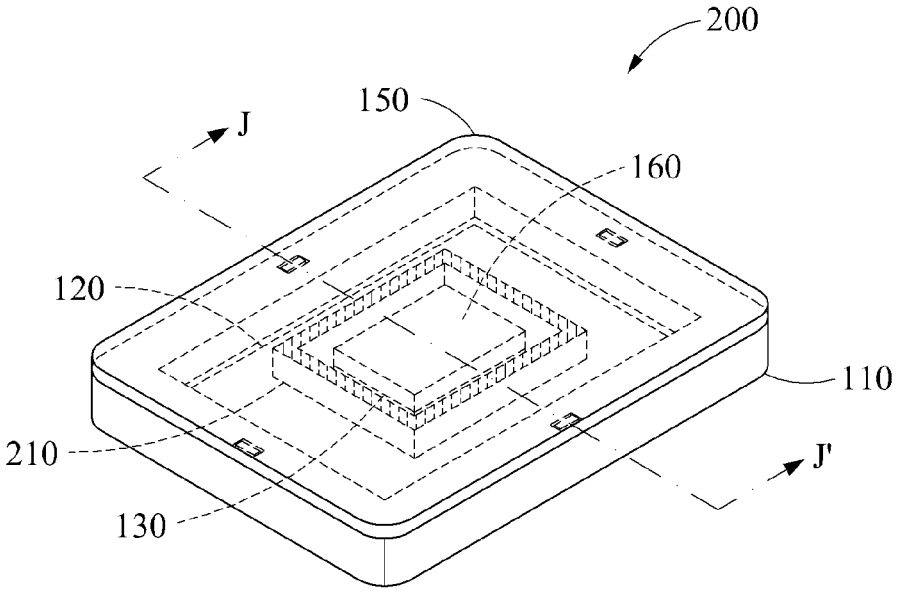
FIG. 2 is a perspective view illustrating an example of a connector assembly.

FIG. 2 is a perspective view illustrating a connector assembly 200. Referring to FIG. 2, the first connector 110 is connected to the second connector 150. When compared to the example in FIG. 1B, a shielding member 210 is additionally provided adjacent to the first electrode 130 and the second electrode 160 of the connector assembly 200. The shielding member 210 is configured to shield the first electrode 130 and the second electrode 160 from an external area, or environment, when the first connector 110 is connected to the second connector 150. The shielding member 210 is configured to block a foreign substance, for example, water and dust from contacting the first electrode 130 and the second electrode 160 from the external area. As an example, the shielding member 210 includes an elastic material disposed between the first elastic layer 120 and an inner surface of the second connector 150. When the first connector 110 is connected to the second connector 150, the first elastic layer 120 and a body of the second connector 150 apply pressure to the shielding member 210, thereby enclosing the first electrode 130 and the second electrode 160. For example, with the first connector 110 being connected to the second connector 150, the shielding member 210 may totally surround the first electrode 130 and the second electrode 160. Thus, the first electrode 130 and the second electrode 160 are shielded from the external area. As another example, the shielding member 210 includes a conductive material. In this example, the shielding member 210 blocks external electromagnetic waves from effecting the first electrode 130 and the second electrode 160, as well as foreign substances from contacting the electrodes.

Figure 3A:
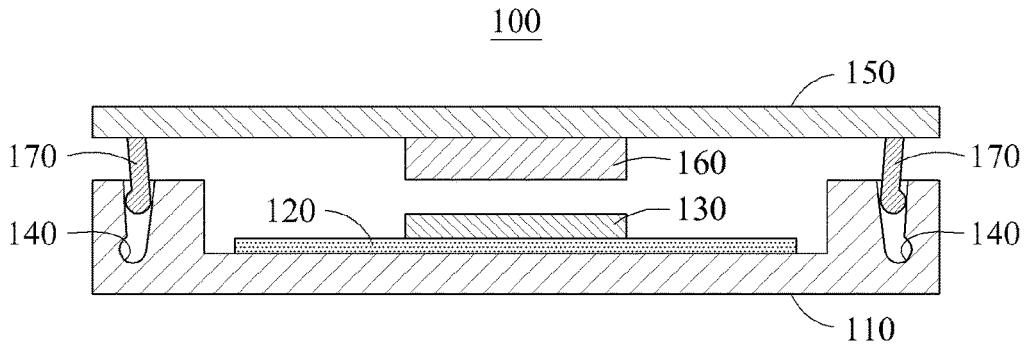
FIGS. 3A through 9 are cross sectional views illustrating examples of a connector assembly.

FIG. 3A is a cross-sectional view illustrating the connector assembly 100 of FIG. 1B along line I-I'. Referring to FIG. 3A, the first connector 110 includes the first elastic layer 120 and the first electrode 130. A body of the first connector 110 is a portion, for example, connected or attached to one element, circuit, or system. A body of the second connector 150 is a portion, for example, connected or attached to another element, circuit, or system. The second connector 150 includes the second electrode 160. In an example, the body of the first connector 110 and the body of the second connector 150 include an insulating material, and have a modulus of elasticity greater than that of the first elastic layer 120. The body of the second connector 150 includes the second fastener 170 provided in a form of a fastening protrusion to engage the first connector 110. The body of the first connector 110 includes the first fastener 140 provided in a form of a fastening groove to accept and engage the second fastener 170, thereby fixing the first connector 110 to the second connector 150.

The first electrode 130 and the second electrode 160 deliver a signal or power and are connected to an internal circuit of a system, or device. A connection between each of the first electrode 130 and the second electrode 160 and another system, or device, may be achieved using a wire or through a soldering, for example only. However, the connection method is not limited to the aforementioned examples.

The first elastic layer 120, included in the first connector 110, is disposed between the body of the first connector 110 and the first electrode 130. The first elastic layer 120 includes at least one layer disposed on the first connector 110 or the second connector 150, or both. FIG. 3A illustrates the first connector 110 having the first elastic layer 120 disposed thereon. The first elastic layer 120 may be laminated on the body of the first connector 110 and includes an elastic material, for example, rubber, silicone, and urethane.

The first connector 110 and the second connector 150 may be formed through a sequential lamination process. As an example only, the first connector 110 may be formed through a process in which the first elastic layer 120 is laminated onto the body of the first connector 110, and the first electrode 130 is laminated onto the first elastic layer 120. The second connector 150 may be formed through a process in which the second electrode 160 is laminated onto the body of the second connector 150. The first electrode 130, the second electrode 160, and the first elastic layer 120 may also be formed through a film-forming process, thereby achieving an ultrathin type connector assembly 100. For example, the connector assembly 100 may be formed through the film-forming process, such as, deposition, coating, and sputtering. In this example, the first electrode 130, the second electrode 160 and the first elastic layer 120 has a thickness of 1 millimeter or less.

Figure 3B:
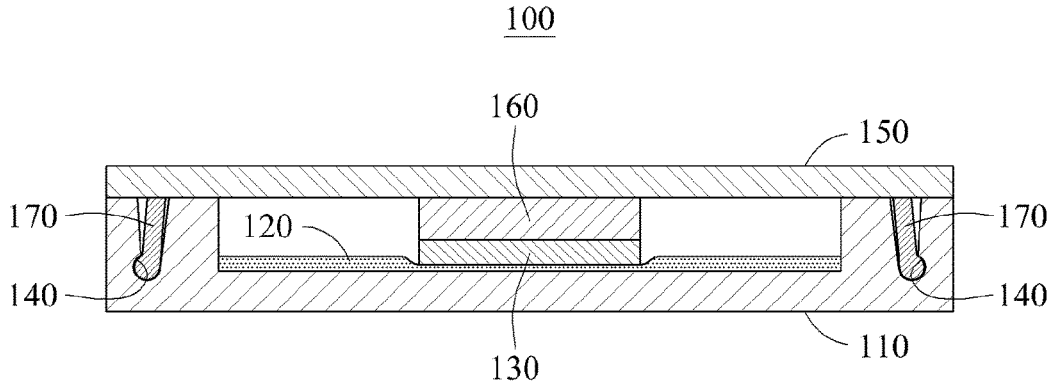

FIG. 3B is a cross-sectional view illustrating the connection assembly 100 wherein the first connector 110 is connected to the second connector 150. Referring to FIG. 3B, in response to a connection between the first connector 110 and the second connector 150, a constant distance between the body of the first connector 110 and the body of the second connector 150 may be maintained. Additionally, the first electrode 130 is connected to the second electrode 160 such that a signal can be transmitted between the first connector 110 and the second connector 150. In this example, the first elastic layer 120 provides a constant compressive force to the first electrode 130 thereby applying a constant pressure to the first electrode 130, which in turn applies a pressure to the second electrode 160 for a stable electrical connection between the first electrode 130 the second electrode 160. That is, when the first connector 110 is connected to the second connector 150, the first elastic layer 120 applies a pressure to the first electrode 130 such that the first electrode 130 is stably connected to the second electrode 160. In response to the connection between the first connector 110 and the second connector 150, a compressive stress is generated within the first elastic layer 120, resulting in a displacement or deformation. The amount of deformation of the first elastic layer 120 is dependent upon the modulus of elasticity of the elastic layer 120. Thus, a material having a low modulus of elasticity may have a relatively large amount of deformation. The first elastic layer 120 functions as a spring. That is, a restoring force is generated when the first elastic layer 120 is deformed. The restoring force is based on the modulus of elasticity and deformation of the elastic layer 120. Additionally, the first elastic layer 120 substantially covers, or encloses, an inner surface of the first cover 110, and may prevent foreign substances, for example, water and dust from contacting the covered surface of first connector 110.

Figure 4A:
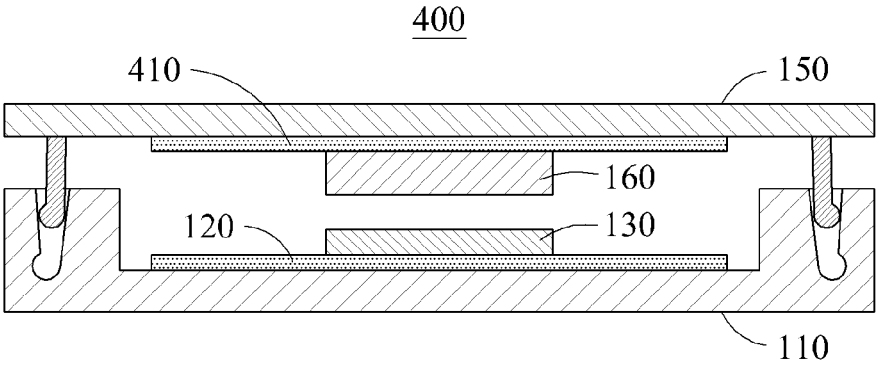
Figure 4B:
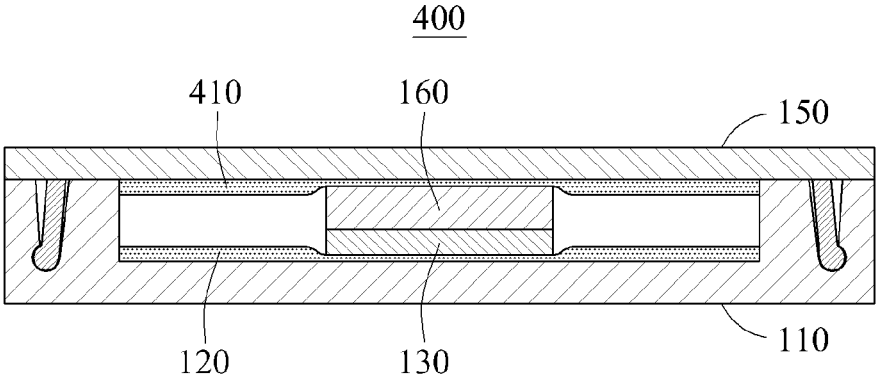

FIG. 4A is a cross-sectional view illustrating an example of a connector assembly 400. Referring to FIG. 4A, the connector assembly 400 includes the first connector 110 including the first elastic layer 120 and the second connector 150 having a second elastic layer 410. The first elastic layer 120 is disposed between a body of the first connector 110 and the first electrode 130, e.g., the first elastic layer 120 is disposed on an inner surface of a body of the first connector 110. The second elastic layer 410 is disposed between a body of the second connector 150 and the second electrode 160, e.g., the second elastic layer 410 is disposed on an inner surface of a body of the second connector 150. As illustrated in FIG. 4B, when the first connector 110 engages the second connector 150, the first elastic layer 120 provides a compressive force to the first electrode 130, and the second elastic layer 410 provides a compressive force to the second electrode 160. Accordingly, first elastic layer 120 and the second elastic layer 410 may provide a stable connection between the first electrode 130 and the second electrode 160 to be maintained, and may prevent an inflow of a foreign substance.

Figure 5:
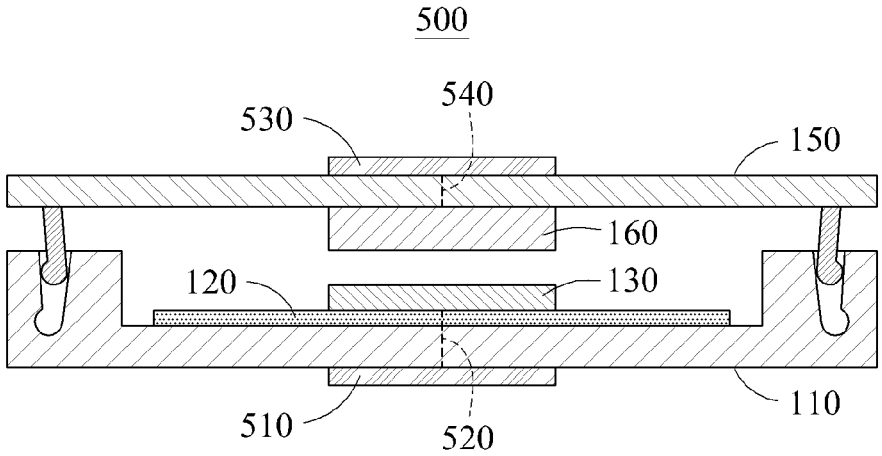

FIG. 5 is a cross-sectional view illustrating a connector assembly 500. Referring to FIG. 5, the connector assembly 500 includes the first connector 110, and a plurality of electrodes 130 and 510 disposed on a top surface and a bottom surface, respectively, of the body of the first connector 110. The outer electrodes 130 and 510 are connected to each other through a wire 520. Similarly, a plurality of electrodes 530 and 160 are disposed on a top surface and a bottom surface, respectively, of the body of the second connector 150, and the electrodes 530 and 160 are connected to each other through a wire 540. As an example, the outer electrodes 510 and 530 are pins or wires. Accordingly, the outer electrodes 510 and 530 may electrically connect the connector assembly 500 to a device, for example a battery, a sensor, or a user interface device, or any combination thereof. The user interface device may include a processor, a memory, or a display, or any combination thereof; however, the user interface device may be varied and not limited thereto. The connector assembly 500 may also provide a removable electrical connection for surface mount technology (SMT), as an example.

Figure 6A:
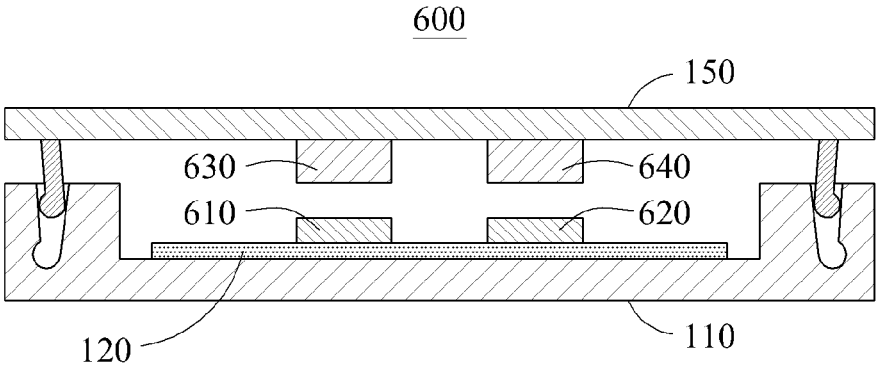

FIG. 6A is a cross-sectional view illustrating a connector assembly 600. Referring to FIG. 6A, the first connector 110 of the connector assembly 600 includes a plurality of first electrodes 610 and 620 arranged on the first elastic layer 120, and the second connector 150 includes a plurality of second electrodes 630 and 640 disposed on an inner surface of the second connector 150, corresponding to the first electrodes 630 and 640. As an example, the first electrodes 610 and 620 and the second electrodes 630 and 640 are arranged, or spaced apart, at preset intervals.

Figure 6B:
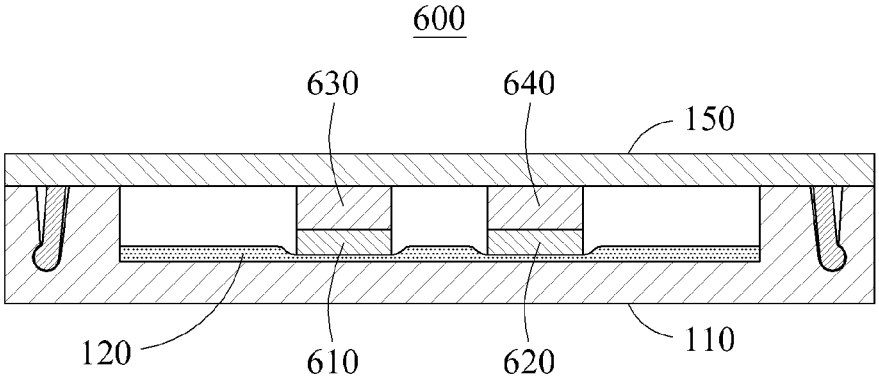

FIG. 6B is a cross-sectional view illustrating the connector assembly 600 including the first connector 110 connected to the second connector 150. Referring to FIG. 6B, in response to a connection between the first connector 110 and the second connector 150, the first electrode 610 and 620 contact the second electrode 630 and 640, respectively, such that a signal may be delivered, or transmitted, between the first connector 110 and the second connector 150. In this example, the first elastic layer 120 covers inner surface of the first connector and provides a compressive force to the first electrodes 610 and 620. The first elastic layer 120 may provide a stable connection between the first electrodes 610 and 620 and the second electrodes 630 and 640, respectively, to be maintained, and also may prevent a foreign substance from contacting the covered inner surface of first connector 110.

Figure 6C:
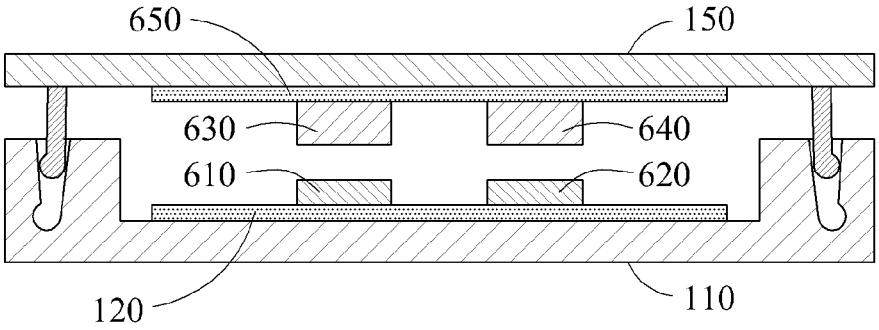

FIG. 6C is a cross-sectional view of the connector assembly 600 including the second connector 150 on which a second elastic layer 650 is additionally provided. Referring to FIG. 6C, the second elastic layer 650 of the second connector 150 is disposed on a lower surface of the second connector 150, and the second electrodes 630 and 640 are disposed thereon. When the first connector 110 is connected to the second connector 150, the first elastic layer 120 and the second elastic layer 650 apply compressive forces to the first electrodes 610 and 620 and the second electrodes 630 and 640, respectively due to deformation of the elastic layers 120 and 650. Thus, a stable connection between the first electrodes 610 and 620 and the second electrodes 630 and 640 may be maintained and may prevent an inflow of a foreign substance from the environment.

Figure 7A:
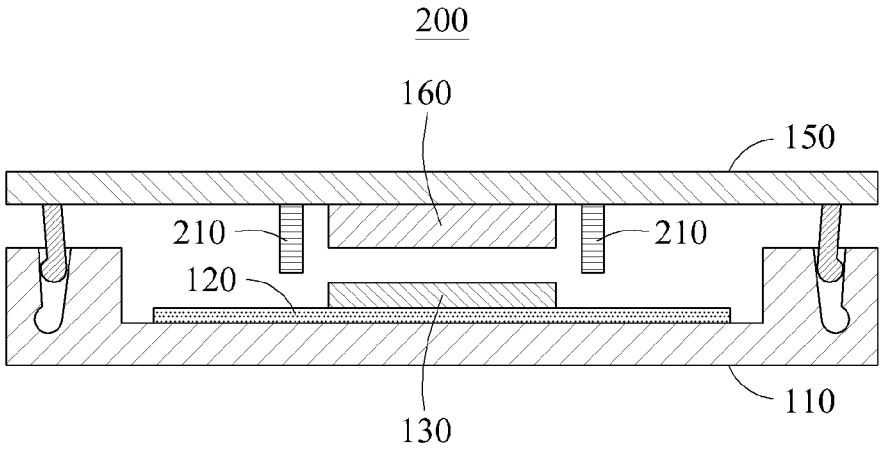

FIG. 7A is a cross-sectional view illustrating the connector assembly 200 along line J-J' of FIG. 2. Referring to FIG. 7A, the connector assembly 200 further includes the shielding member 210 disposed adjacent to at least one of the first electrode 130 and the second electrode 160. When the first connector 110 and the second connector 150 are connected to each other, the shielding member 210 may shield the first electrode 130 and the second electrode 160 from an external area, or environment and may prevent a foreign substance, for example, water and dust, from passing the shield.

In an example, the shielding member 210 may also block electromagnetic waves from the external area, or environment, interfering with the first electrode 130 and the second electrode 160. Thus, the first electrode 130 and/or the second electrode 160 is protected from an undesired or interference signal from an external area or environment. In this example, the shielding member 210 may be a conductive material or include a thin metal film disposed on the shielding member 210. To form the thin metal film on the shielding member 210, various schemes, for example, sputtering, spray coating, vapor disposition, electroplating, and non-electroplating may be applied.

Figure 7B:
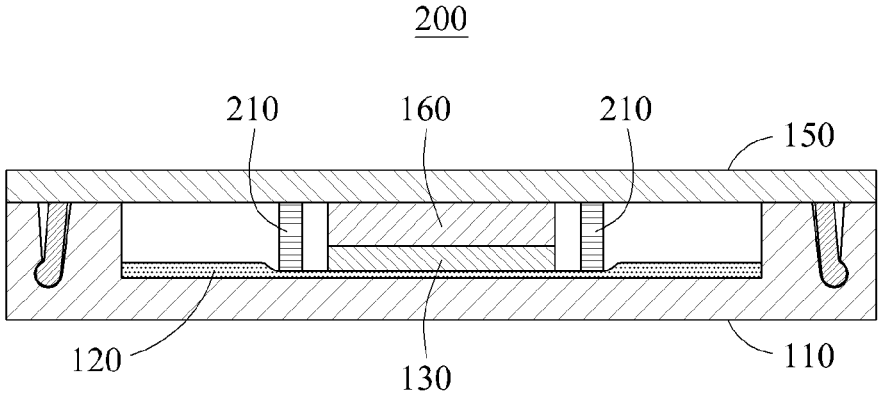

FIG. 7B is a cross-section view illustrating the connector assembly 200 including the first connector 110 and the second connector 150 connected to each other. Referring to FIG. 7B, when the first connector 110 and the second connector 150 engage each other, the first elastic layer 120 provides a compressive force to the first electrode 130 which contacts the second electrode 160. In this example, the first elastic layer 120 deforms from the compressive force of the shielding member 210 generated by the first connector 110 and the second connector 150 engaging each other. Accordingly, shielding member 210 and the deformed first elastic layer 120 may seal the area surrounding the first electrode 130 and the second electrode 160. Thus, the first electrode 130 and the second electrode 160 may be shielded from the external area, or environment, by the shielding member 210 and the first elastic member, and may thereby achieve a waterproof and dustproof environment between the shield member 210 and the first and second electrodes 130 and 160.

Figure 8:
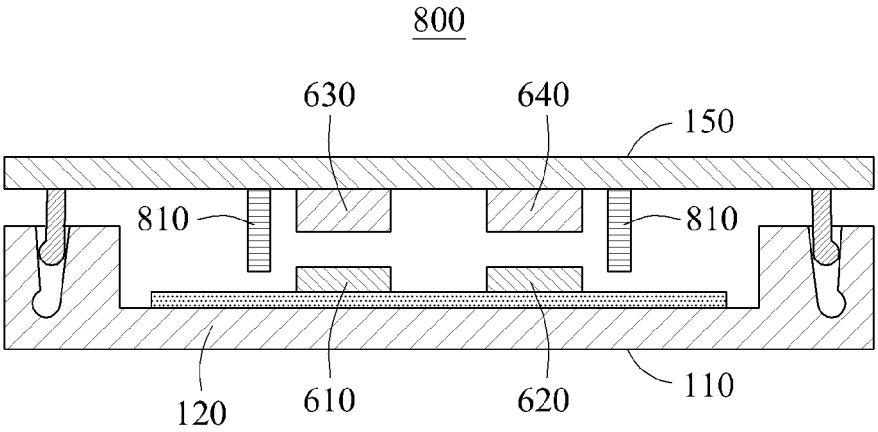

FIG. 8 is a cross-sectional view illustrating a connector assembly 800. Referring to FIG. 8, the connector assembly 800 includes the first connector 110 having a plurality of first electrodes 610 and 620 and the second connector 150 having second electrodes 630 and 640 corresponding to the first electrodes 610 and 620, respectively. Also, the connector assembly 800 further includes a the shielding member 810 disposed in an area adjacent to at least one of the first electrodes 610 and 620 and the second electrodes 630 and 640, respectively. The shielding member 810 may prevent a foreign substance or electromagnetic waves from entering the area adjacent to the first electrodes 610 and 620 and the second electrodes 630 and 640 after the first connector 110 and the second connector 150 are connected to each other.

Figure 9:
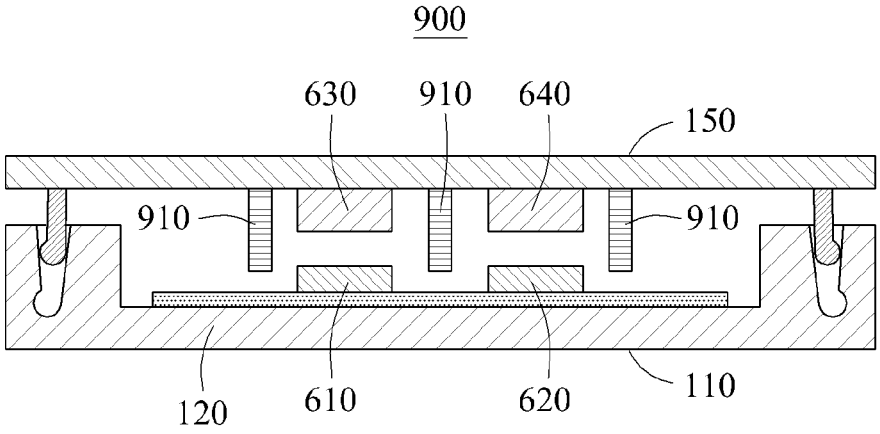

FIG. 9 is a cross-sectional view illustrating a connector assembly 900. As illustrated in FIG. 9, shielding members 910 surround the first electrodes 610 and 620 and the second electrodes 630 and 640. In this example, a connection between the first electrode 610 and the second electrode 630 and a connection between the first electrode 620 and the second electrode 640 are independently protected by the shielding members 910 for each pair of a first electrode and a second electrode.

A connector assembly, without a mechanical coil or flat spring and, thus, having a simplified manufacturing process is described above. In addition, the above described connector assembly without a mechanical coil spring or flat spring may have an added advantage of consistent restoring force. To achieve consistent restoring force, an elastic layer is applied to the connector assembly, thereby increasing durability and allowing a design of a connector suitable for an ultrathin form.

Figure 10:
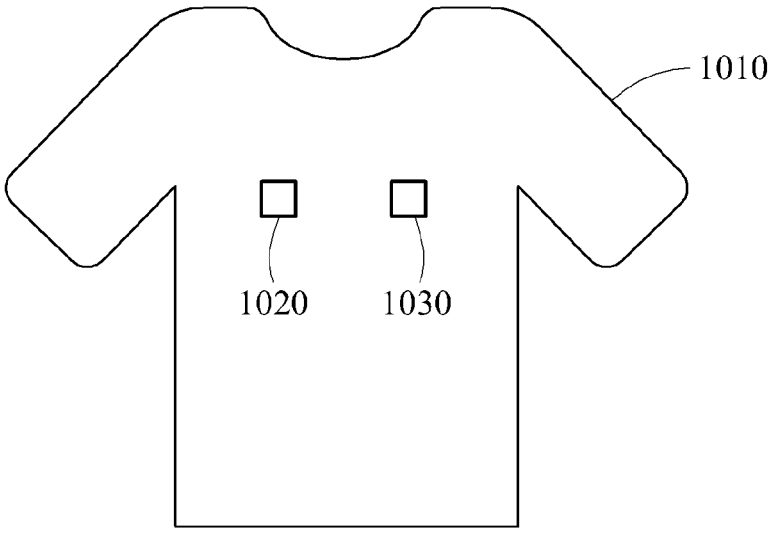
FIGS. 10 through 12 illustrate examples to which a connector assembly is applied.
Figure 11:
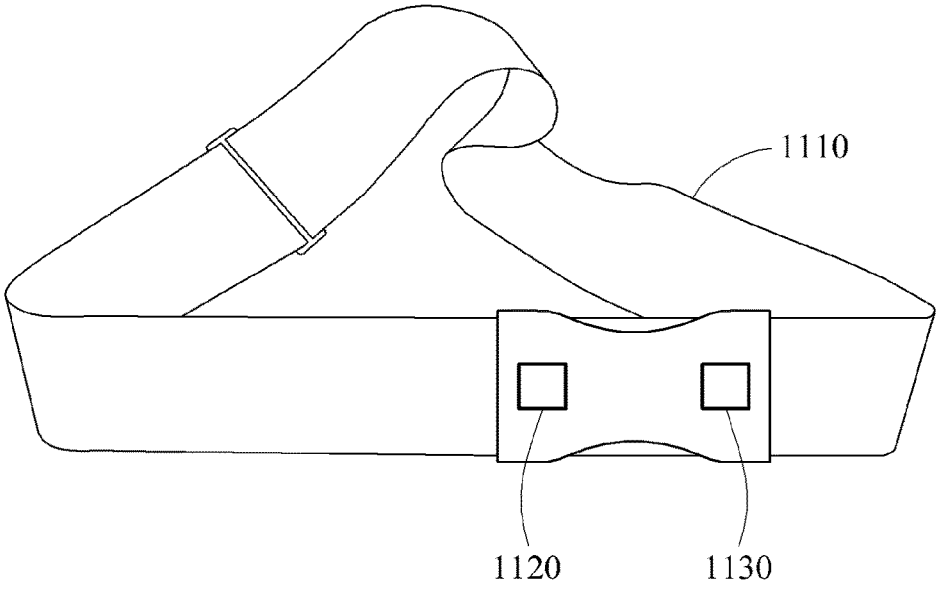
Figure 12:
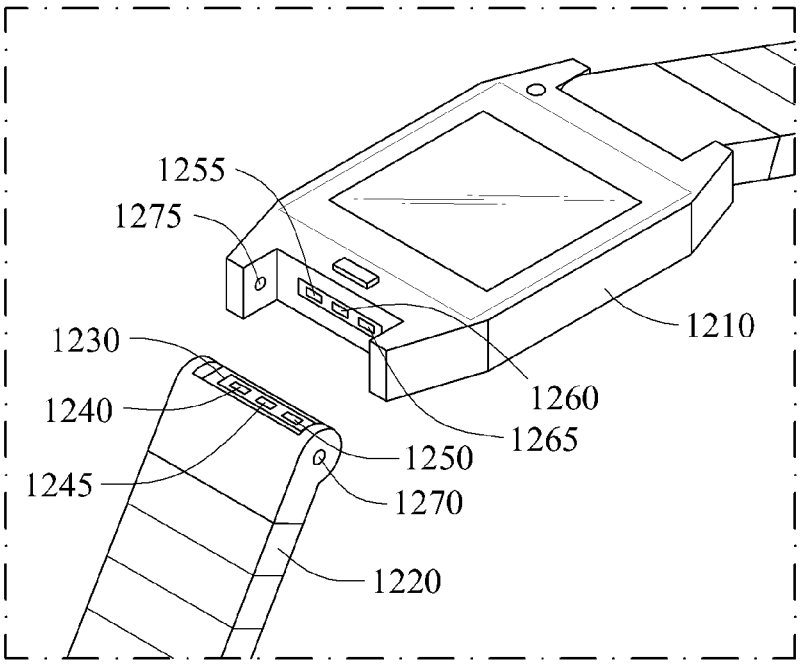

FIGS. 10 through 12 illustrate examples to which a connector assembly is applied.

FIG. 10 illustrates an example of a connector assembly applied to a clothing platform. The connector assembly is applicable to a everyday environment field in which a waterproof function is desired, for example, clothing. The connector assembly functions to connect devices to be removably attached to clothes. Referring to FIG. 10, the clothes 1010 may include one or more sensors configured to sense a biosignal, for example, an electrocardiogram (ECG), an electromyography (EMG), Electrodermal activity (EDA), Galvanic skin response (GSR), or any combination thereof. A plurality of connector assemblies 1020 and 1030 transfer the biosignal sensed by the sensor to a device. Also, a first connector configured to receive the biosignal from the sensor is provided in the clothes 1010. A second connector detachably attached to the first connector is connected to a signal processing circuit for processing the biosignal. In an example, the signal processing circuit performs a signal processing, for example, filtering, amplifying, and digital signal conversion of the biosignal and then, transfers a digital signal into which the biosignal is converted to another device.

A plurality of contact points are formed using the plurality of connector assemblies 1020 and 1030 included in the clothes 1010. A single connector assembly functions as a single module and the plurality of connector assemblies 1020 and 1030 are arranged in different locations of the clothes 1010. Through this, the plurality of contact points is formed. In this example, an arrangement of the plurality of connector assemblies 1020 and 1030 is determined by another portion connecting to the plurality of connector assemblies 1020 and 1030.

FIG. 11 illustrates an example of a connector assembly applied to a belt used to sense a biosignal. Referring to FIG. 11, a belt 1110 includes a sensor configured to sense a biosignal and a plurality of connector assemblies 1120 and 1130 configured to transmit the biosignal sensed by the sensor. When first connectors are respectively connected to second connectors in the plurality of connector assemblies 1120 and 1130, the biosignal sensed by the sensor may be transferred to a signal processing circuit for processing the biosignal through the first connectors and the second connectors.

FIG. 12 illustrates an example of a connector assembly applied in a watch-type wearable device embodiment. The connector assembly may provide an electrical connection between a body 1210 and a strap 1220 of the wearable device. As an example, when the strap 1220 may include a sensor configured to sense a biosignal, for example, an ECG or a photoplethysmogram (PPG), or both. The biosignal may be transmitted from the strap 1220 to the body 1210 through the connector assembly, or a control signal for controlling a function of the sensor included in the strap 1220 is transmitted from the body 1210 to the strap 1220. The watch-type wearable device of FIG. 12 represents at least one processing device for processing biosensor data and providing the received sensor data to a user interface, such as a display, for example.

A first connector of the connector assembly is included in the strap 1220, and a second connector is included in the body 1210. The connecting portions 1270 and 1275 enable the strap 1220 to be removably attached to the body 1210. When the strap 1220 and the body 1210 are connected to each other, the first connector and the second connector engage one another. In this example, first electrodes 1240, 1245, and 1250 of the first connector may be connected to corresponding second electrodes 1255, 1260, and 1265 of the second connector. A first elastic layer 1230 disposed on the first connector provides a compressive force to the first electrodes 1240, 1245, and 1250, thereby maintaining stable connections of the first electrodes 1240, 1245, and 1250 and the second electrodes 1255, 1260, and 1265. Also, the first elastic layer 1230 protects the strap 1220 from foreign substances entering the between strap 1220 and the body 1210.

One or more embodiments include an electronic device or system that includes at least one of connector/body of a connector assembly illustrated in any of FIGS. 1A-12, such as the watch type wearable device of FIG. 12. As a non-exhaustive example only, a wearable device as described herein may be a mobile device, such as a cellular phone, a smart phone, a wearable smart device (such as a ring, a watch, a pair of glasses, a bracelet, an ankle bracelet, a belt, a necklace, an earring, a headband, a helmet, or a device embedded in clothing, such as a shirt or pants), a portable personal computer (PC) (such as a laptop, a notebook, a subnotebook, a netbook, or an ultra-mobile PC (UMPC), a tablet PC (tablet), a phablet, a personal digital assistant (PDA), a digital camera, a portable game console, an MP3 player, a portable/personal multimedia player (PMP), a handheld e-book, a global positioning system (GPS) navigation device, or a sensor, or a stationary device, such as a desktop PC, a high-definition television (HDTV), a DVD player, a Blu-ray player, a set-top box, or a home appliance, or any other mobile or stationary device capable of wireless or network communication. In one example, a wearable device is a device that is designed to be mountable directly on the body of the user, such as a pair of glasses or a bracelet. In another example, a wearable device is any device that is mounted on the body of the user using an attaching device, such as a smart phone or a tablet attached to the arm of a user using an armband, or hung around the neck of the user using a lanyard.

For simplicity, the singular term "processor" or "computer" may be used in the description of the examples described herein, but in other examples multiple processors or computers are used, or a processor or computer includes multiple processing elements, or multiple types of processing elements, or both. In one example, a hardware component includes multiple processors, and in another example, a hardware component includes a processor and a controller. A hardware component has any one or more of different processing configurations, examples of which include a single processor, independent processors, parallel processors, single-instruction single-data (SISD) multiprocessing, single-instruction multiple-data (SIMD) multiprocessing, multiple-instruction single-data (MISD) multiprocessing, and multiple-instruction multiple-data (MIMD) multiprocessing.

The methods that perform the operations described herein are performed by a processor or a computer as described above executing instructions or software to perform the operations described herein.

Examples of a non-transitory computer-readable storage medium include read-only memory (ROM), random-access memory (RAM), flash memory, CD-ROMs, CD-Rs, CD+Rs, CD-RWs, CD+RWs, DVD-ROMs, DVD-Rs, DVD+Rs, DVD-RWs, DVD+RWs, DVD-RAMs, BD-ROMs, BD-Rs, BD-R LTHs, BD-REs, magnetic tapes, floppy disks, magneto-optical data storage devices, optical data storage devices, hard disks, solid-state disks, and any device known to one of ordinary skill in the art that is capable of storing the instructions or software and any associated data, data files, and data structures in a non-transitory manner and providing the instructions or software and any associated data, data files, and data structures to a processor or computer so that the processor or computer can execute the instructions. In one example, the instructions or software and any associated data, data files, and data structures are distributed over network-coupled computer systems so that the instructions and software and any associated data, data files, and data structures are stored, accessed, and executed in a distributed fashion by the processor or computer.

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A connector assembly comprising:

a first connector body having a cavity;

a first elastic layer disposed within the cavity of the first connector body;

a first electrode disposed on the first elastic layer, the first electrode being laminated onto the first elastic layer in a film form;

a second connector body; and a second electrode disposed to protrude from the second connector, wherein the first connector body interacts with the second connector body resulting in the second electrode contacting the first electrode and causing the first elastic layer to provide a sealing compressive force to the first electrode such that both the first electrode and the second electrode are positioned within the cavity of the first connector body.

2. The connector assembly of claim 1, wherein the first electrode is configured to contact the second electrode upon the first connector body engaging the second connector body.

3. The connector assembly of claim 1, wherein the first elastic layer is configured to block a foreign substance entering an area adjacent the first electrode and the second electrode upon the first connector body engaging the second connector body.

4. The connector assembly of claim 1, further comprising:

a second elastic layer disposed between the second electrode and the second connector body.

5. The connector assembly of claim 4, wherein the second elastic layer is configured to provide the sealing compressive force to the second electrode upon the first connector body engaging the second connector body.

6. The connector assembly of claim 1, further comprising:

a shielding member disposed on the second connector body and disposed adjacent to at least one of the first electrode and the second electrode such that the shielding member is positioned within the cavity of the first connector body when the first connector body engages the second connector body.

7. The connector assembly of claim 6, wherein the shielding member and the first elastic layer are configured to seal the connector assembly from a foreign substance entering an area adjacent to the first electrode and the second electrode upon the first connector body engaging the second connector body.

8. The connector assembly of claim 6, wherein the shielding member includes an elastic material.

9. The connector assembly of claim 6, wherein the shielding member is configured to block external electromagnetic waves entering the first electrode and the second electrode upon the first connector body engaging the second connector body.

10. The connector assembly of claim 9, wherein the shielding member includes a conductive material.

11. The connector assembly of claim 1, wherein the first connector body and the second connector body are connected to separate circuits.

12. The connector assembly of claim 1, wherein at least the first connector is included in an electronic device that includes a processing device configured to receive a signal from the second connector body.

13. The connector assembly of claim 12, wherein the second connector body comprises a biosensor.

14. A connector assembly comprising:

a first connector body having a cavity;

a first elastic layer disposed on the first connector body;

first electrodes disposed on an upper surface of the first elastic layer, the first electrodes being laminated onto the first elastic layer in film forms;

a second connector body; and second electrodes disposed to protrude from the second connector body and corresponding to the first electrodes, wherein the first connector body interacts with the second connector body resulting in the second electrodes contacting respective first electrodes to cause the first elastic layer to provide a sealing compressive force to the first electrodes, and wherein the first elastic layer and the first electrodes are positioned entirely within the cavity of the first connector body when the first connector body is disconnected from the second connector body.

15. The connector assembly of claim 14, wherein the first elastic layer is configured to provide the sealing compressive force to the first electrodes upon the first connector body connecting to the second connector body.

16. The connector assembly of claim 14, wherein the first elastic layer is configured to block a foreign substance entering an area adjacent to the first electrodes and the second electrodes upon the first connector body engaging the second connector body.

17. The connector assembly of claim 14, further comprising:

a second elastic layer disposed between the second connector body and the second electrodes.

18. The connector assembly of claim 14, further comprising:

a shielding member disposed in an area adjacent to at least one of the first electrodes and the second electrodes, wherein the shielding member has a vertical length greater than a vertical length of the second electrodes such that the shielding member is positioned in the cavity of the first connector body upon the first connector body connecting to the second connector body.

19. The connector assembly of claim 18, wherein the shielding member and the first elastic layer are configured to seal the connector assembly from a foreign substance or an electromagnetic wave, or both, from entering an area adjacent to the first electrodes and the second electrodes upon the first connector body connecting to the second connector body.

20. A connector assembly comprising:

a first connector;

a first elastic layer disposed on the first connector;

a first electrode disposed on an upper surface of the first elastic layer, the first electrode being laminated onto the first elastic layer in a film form; and a processor device electrically connected with the first electrode, wherein the first connector is configured to be connected to a second connector that supports a second electrode protruding from the second connector, with the processor device configured to receive a biosignal from a biosensor connected to the second connector, wherein the first electrode is configured to be positioned within a cavity of the second connector when the first connector is connected to the second connector, and wherein the first connector body engages the second connector body resulting in the second electrode contacting the first electrode causing the first elastic layer to provide a sealing compressive force to the first electrode.

21. The connector assembly of claim 20, wherein the second electrode is disposed on the second connector and corresponding to the first electrode, and wherein a first fastener of the first connector receives a second fastener of the second connector.

22. The connector assembly of claim 21, wherein the first fastener is a fastening groove and the second fastener is a fastening protrusion.

23. The connector assembly of claim 22, wherein the fastening protrusion includes a laterally outward extending protrusion and the fastening groove has a corresponding laterally extending groove configured to receive the laterally outward extending protrusion.

* * * * *